United States Patent [19]

Tsuji et al.

[11] Patent Number: 5,017,962

[45] Date of Patent: May 21, 1991

[54] IMAGE FORMING APPARATUS WITH PROCESS-CARTRIDGES

[75] Inventors: Masaru Tsuji, Nara; Atsuyuki Katoh, Tenri; Keizo Fukunaga, Nara, all of Japan

[73] Assignee: Sharp Kabushiki Kaisha, Osaka, Japan

[21] Appl. No.: 366,166

[22] Filed: Jun. 14, 1989

[30] Foreign Application Priority Data

Jun. 20, 1988 [JP] Japan ..... 63-152917

[51] Int. Cl.[5] ..... G03G 15/06; G03G 21/00

[52] U.S. Cl. ..... 355/210; 355/245; 355/260

[58] Field of Search ..... 355/200, 210, 245, 260

[56] References Cited

U.S. PATENT DOCUMENTS

| | | | |
|---|---|---|---|
| 4,089,601 | 5/1978 | Navone | 355/245 |
| 4,607,939 | 8/1986 | Saito | 355/200 |
| 4,660,960 | 4/1987 | Fukunaga et al. | 355/260 |
| 4,821,063 | 4/1989 | Kaneshige | 355/210 |
| 4,849,791 | 7/1989 | Hagihara et al. | 355/260 X |

FOREIGN PATENT DOCUMENTS

| | | | |
|---|---|---|---|
| 3522296 | 11/1987 | Fed. Rep. of Germany . | |
| 61-26073 | 2/1986 | Japan | 355/260 |
| 62-32483 | 2/1987 | Japan . | |
| 62-175767 | 8/1987 | Japan | 355/260 |

*Primary Examiner*—Fred L. Braun

*Attorney, Agent, or Firm*—Irell & Manella

[57] ABSTRACT

An apparatus for the formation of images which includes two process-cartridges, one of which is a photosensitive cartridge including a photosensitive drum, a charger, a cleaning device, and the like, and the other of which is a developing cartridge including a developing device, a toner storage container, and a used toner collecting container; the developing cartridge being separated into a first cartridge including the developing device alone and a second cartridge including the toner storage container and the used toner collecting container, where the lifetime of the photosensitive cartridge is a first integer times the lifetime of the first cartridge, and the lifetime of the first cartridge is a second integer times the lifetime of the second cartridge, where each of the first and second integers is greater than one.

2 Claims, 3 Drawing Sheets

IMAGE FORMING APPARATUS WITH PROCESS-CARTRIDGES

BACKGROUND OF THE INVENTION

1. Field of the Invention:

The invention relates to an apparatus for the formation of images utilizing electrophotography, which comprises process-cartridges detachably mounted in the body of the apparatus, each of the said cartridges integrally housing process-units for carrying out each process of the electrophotography.

2. Description of the prior art:

In recent years, an apparatus for the formation of images such as a copying apparatus, a laser printer, or the like, in which a process-cartridge integrally comprising process-units such as a photosensitive drum, a charger, a cleaning device, a developing device, a toner storage container, a used toner collecting container, and the like, is detachably mounted in the body of the apparatus, has been put into practical use. Such an apparatus comprising one process-cartridge is advantageous in that a variety of work for the maintenance of the apparatus, such as toner resupply, disposal of used toner, replacement of the photosensitive drum or other process-units, and the like, can all be done at the same time by anyone just by replacing one process-cartridge with a new one, while this kind of work can be done only by a specialist in the case of an apparatus having no process-cartridge.

In such an apparatus, the single process-cartridge includes all process-units as described above but these process-units usually differ in lifetime. Thus, when the lifetime of one of the process-units expires, all of them are replaced with new ones in the single process-cartridge. In this way, all the other process-units which can still be used are also discarded. This causes a high cost of the maintenance for the whole apparatus.

Japanese Laid-Open Patent Publication No. 62-32483 discloses an apparatus for the formation of images for the purpose of overcoming this problem. This apparatus comprises two process-cartridges, which are detachably mounted in the body of the apparatus. One is a photosensitive cartridge including a photosensitive means and its peripheral devices such as a cleaning device and the like. The other is a developing cartridge which includes devices related to the developing process such as a developing device, a toner storage container, and the like. The lifetime of the photosensitive cartridge expires at the time when about 5,000–20,000 sheets of copy paper are printed with use of the whole apparatus. The lifetime of the developing cartridge, which depends on the volume of developer stored in the toner storage container, expires at the time when about 500–5,000 sheets are printed with use of the whole apparatus. Thus, when the lifetime of one cartridge expires, it can be separately replaced with a new one, with the other cartridge still kept within the body, so that each cartridge can be used until its lifetime expires, resulting in relatively improved economy in the maintenance of the whole apparatus.

Moreover, this apparatus is provided with a means for transporting used toner collected by the cleaning device of the photosensitive cartridge into the developing cartridge. Thus, a used toner collecting container for keeping the used toner therein need not be disposed within the photosensitive cartridge and can be disposed within the developing cartridge instead. The lifetime of the photosensitive drum and its peripheral devices within the photosensitive cartridge is far longer than that of the used toner collecting container. If the used toner collecting container is disposed in the photosensitive cartridge, it must be made remarkably large so as to have a lifetime equivalent to that of the photosensitive drum and its peripheral devices, resulting in a photosensitive cartridge of a remarkably large size. This will prevent the whole apparatus from being miniaturized. On the other hand, with this apparatus in which the used toner collecting container is not disposed in the photosensitive cartridge but disposed in the developing cartridge, the used toner collecting container need not be made so large since the lifetime of the process-units in the developing cartridge is not so long as that of the photosensitive cartridge. This enables the miniaturization of the whole apparatus.

In such an apparatus comprising two process-cartridges, although the process-units in the photosensitive cartridge do not differ in lifetime to a great degree and thus can be fully used until their lifetime expires, the developing cartridge still has problems as will be described below.

The developing cartridge of the apparatus integrally comprises a developing device, a toner storage container, and a used toner collecting container. Thus, even when the lifetime of only one of them expires, all of these three process-units should be replaced with new ones as one developing cartridge. The maximum number of copy sheets that can be printed with use of the developing device depends on the kinds of developer. When one-component developer is used, the maximum number of sheets that can be printed with use of the developing device is nearly infinite. When two-component developer is used, the maximum number is about 10,000. In general, the toner storage container has a volume for toner with which a maximum of about 500–5,000 of copy sheets can be printed. The lifetime of the used toner container is substantially as long as that of the toner storage container. Thus, the lifetime of the developing device is far longer than that of these two containers; even when the two-component developer is used, the lifetime of the former is twice as long as that of the latter. As described above, the two containers and the developing device should be replaced with new ones together as one cartridge. Thus, when the lifetime of the containers expires first, the developing device which can still be used for a long time should also be discarded together with them. This causes an increased cost of maintenance of the whole apparatus. On the other hand, if the lifetime of the two containers is set to be equivalent to that of the developing device utilizing the twocomponent developer, the above problem of the high maintenance cost may be solved, but the toner storage container and the used toner collecting container must be doubled in size. This will prevent the whole apparatus from being miniaturized.

SUMMARY OF THE INVENTION

The apparatus for the formation of images of this invention, which comprises the above-discussed and numerous other disadvantages and deficiencies of the prior art, comprises two process-cartridges, one of which is a photosensitive cartridge including a photosensitive drum, a charger, a cleaning device, and the like, and the other of which is a developing cartridge including a developing device, a toner storage container, and a used toner collecting container; said developing cartridge being separated into a first cartridge including said developing device alone and a second cartridge including said toner storage container and said used toner collecting container.

In a preferred embodiment, the maximum number of sheets of copy paper that can be printed with use of toner stored in said toner storage container of said second cartridge is half as large as that with use of said developing device of said first cartridge.

In a preferred embodiment, used toner which is collected by means of said cleaning device of said photosensitive cartridge is transported into said used toner collecting container of said developing cartridge.

Thus, the invention described herein makes possible the objectives of (1) providing a miniaturized apparatus for the formation of images comprising a developing cartridge of a reduced size in which the volume of developer need not be made larger to attain a prolonged lifetime in accordance with the lifetime of a developing device; (2) providing an apparatus for the formation of images in which process-cartridges can be separated from each other so that only one process-cartridge the lifetime of which has expired can separately be replaced with a new one, and that the other process-cartridges which can still be used need not be discarded therewith and can be fully used until their lifetime expires, resulting in a low maintenance cost; and (3) providing an apparatus for the formation of images in which the lifetime of the photosensitive cartridge is substantially three times as long as that of the first cartridge and the lifetime of the first cartridge is substantially twice as long as that of the second cartridge, so that the first and second cartridges can be replaced with new ones together at the time when the lifetime of the first cartridge expires, and that all the cartridges can be replaced with new ones together at the time when the lifetime of the photosensitive cartridge expires.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

Figure 5:
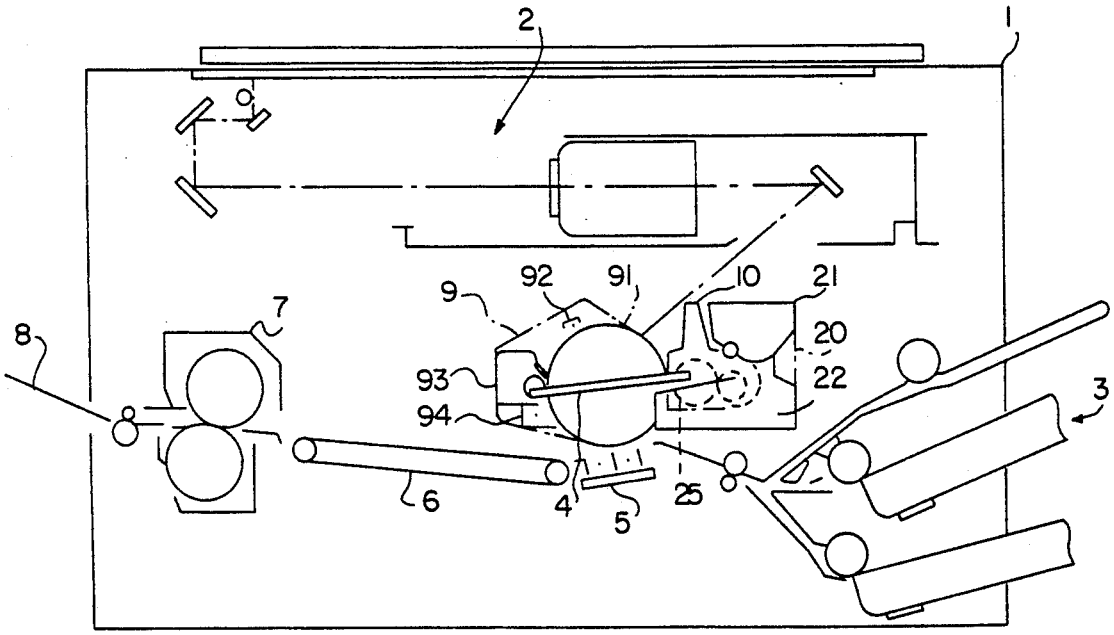
FIG. 5 is a sectional side elevation of an apparatus for the formation of images of the invention.

FIG. 5 shows an apparatus for the formation of images in accordance with the invention. The apparatus comprises the body 1, in the substantial center of which a photosensitive cartridge 9 including a photosensitive drum 91, a charger 92, a cleaning device 93, and a discharger 94 is disposed. A first cartridge 10 comprising a developing device alone and a second cartridge 20 comprising a toner storage container 21 and a used toner collecting container 22 are disposed at one side of the photosensitive cartridge 9. A used toner collecting pipe 4 is connected between the cleaning device 93 in the photosensitive cartridge 9 and a used toner inlet 25 of the used toner collecting container 22 in the second cartridge 20. The first and second cartridges 10 and 20 constitute a developing cartridge. The second cartridge 20 can be separated from the first cartridge 10, so that only the second cartridge 20 need be removed from the body 1, with the first cartridge 10 still kept attached to the body 1. The whole developing cartridge can, of course, be removed, that is, both of the first and second cartridges 10 and 20 can also be removed together from the body 1. The second cartridge 20 is connected to the first cartridge 10 by means of a known engaging member such as a rail in such a manner that the second cartridge 20 can be readily separated by a sliding action from the first cartridge 10.

Figure 1:
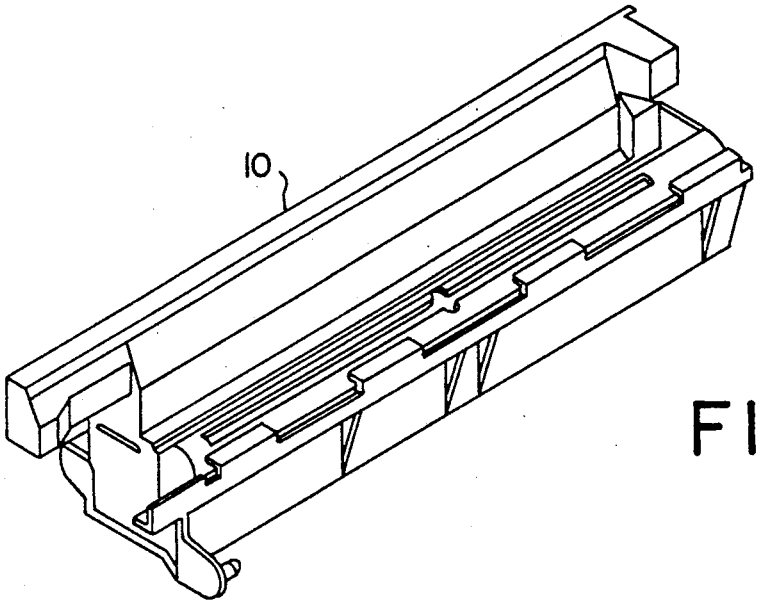
FIG. 1 is a perspective view of a first cartridge of an apparatus for the formation of images of the invention.
Figure 2:
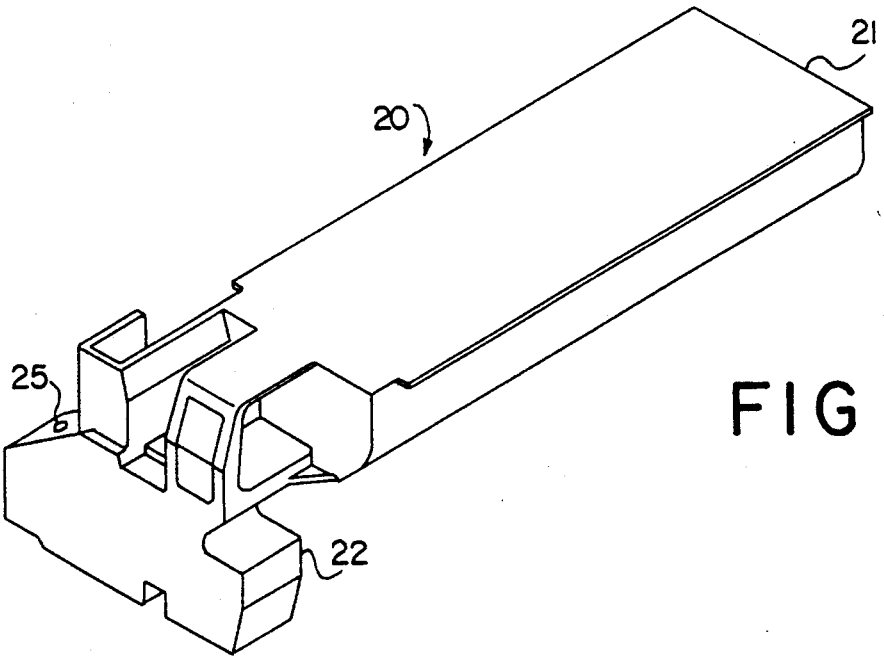
FIG. 2 is a perspective view of a second cartridge of the apparatus for the formation of images of the invention.

FIG. 1 is a perspective view of the first cartridge 10 comprising the developing device alone. FIG. 2 is a perspective view of the second cartridge 20, which comprises the toner storage container 21 and the used toner collecting container 22. The cleaning device 93 of the photosensitive cartridge 9 is connected to one end of the used toner collecting pipe 4, the other end of which is connected to the used toner collecting inlet 25 of the used toner collecting container 22, as mentioned above (See FIG. 5). The toner which remains on the surface of the photosensitive drum 91 after printing operation is first collected by the cleaning device 93 of the photosensitive cartridge 9 and then transported into the used toner collecting container 22 through the used toner collecting pipe 4.

Figure 3:
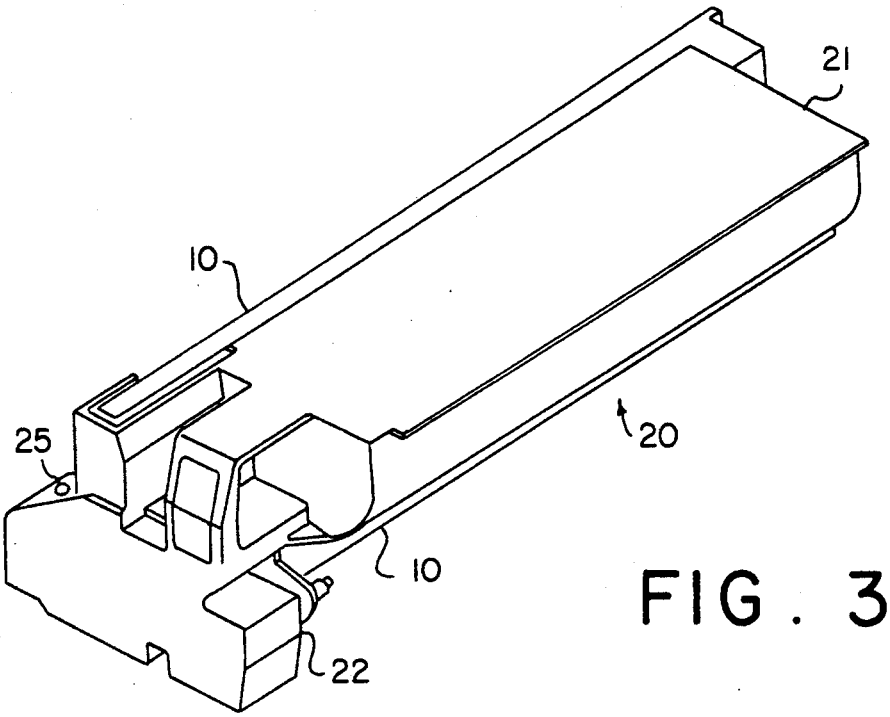
FIG. 3 is a perspective view of the first and second cartridges connected together.
Figure 4:
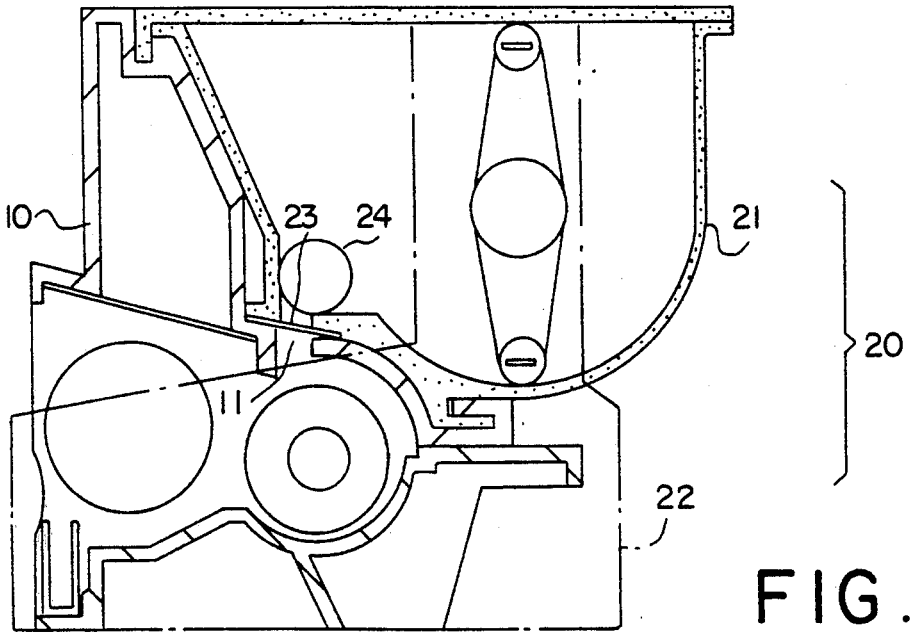
FIG. 4 is a cross-sectional view of the first and second cartridges connected together shown in FIG. 3.

FIG. 3 is a perspective view of the developing cartridge which comprises the first cartridge 10 and the second cartridge 20. The first and second cartridges 10 and 20 are connected together in such a manner that the developing device of the first cartridge 10 is attached to the toner storage container 21 of the second cartridge 20. As shown in FIG. 4, the developing device and the toner storage container 21 are provided with a toner intake 11 and a toner supply outlet 23, respectively, through both of which toner stored in the toner storage container 21 is supplied into the developing device. The toner is properly supplied with the aid of a roller 24.

Referring back to FIG. 5, an optical system 2 comprising a lamp, four mirrors, and lenses is disposed above the photosensitive cartridge 9. A paper supply member 3 is located below the first and second cartridge 10 and 20, and a transfer/separating charger 5 is disposed below the photosensitive drum 91 of the photosensitive cartridge 9. A fixing device 7 is mounted within the body 1 in the vicinity of one side thereof, which is the opposite side to that having the paper supply member 3. A paper conveyer 6 is mounted between the transfer/separating charger 5 and the fixing device 7. A paper discharge member 8 which is adjacent to the fixing device 7 protrudes from the body 1.

The process of forming an image with use of the apparatus of this example will now be described. When an operation key is pressed, the optical system 2 is actuated to irradiate the photosensitive drum 91 so that a latent image which corresponds to an original is formed on the photosensitive drum 91. Then, toner is applied to the latent image by means of the developing device of the first cartridge 10, resulting in a toner image. The toner image is transferred by the transfer/separating charger 5 onto a sheet of copy paper which has been supplied into the body 1 from the paper supply member 3. The copy sheet onto which the toner image has been transferred is then transported by the paper conveyer 6 to the fixing device 7, in which the toner image is fixed to the copy sheet. Then, the sheet is discharged out of the body 1 onto the paper discharge member 8.

In the apparatus of this example, the lifetime of each process-cartridge, which is determined by the maximum number of copy sheets that can be printed with use of each cartridge, is set to be as listed below:

| Cartridge | Lifetime (Maximum number of copy sheets that can be printed with use of each cartridge) |
|---|---|
| First cartridge 10 (comprising the developing device) | about 10,000 |
| Second cartridge 20 (comprising the toner storage container 21 and the used toner collecting container 22) | about 5,000 |
| Photosensitive cartridge 9 | about 30,000 |

As shown in the table, when approximately about 5,000 sheets of copy paper are printed with use of the apparatus of this example, the lifetime of the second cartridge 20 expires; that is, toner stored in the toner storage container 21 is used up and the used toner collecting container 22 is full of used toner. Thus, at the time when about 5,000 sheets are printed, only the second cartridge 20 is replaced with a new one. When about 10,000 sheets of copy paper are printed with use of the apparatus of this example, the lifetime of the first cartridge 10 expires as listed above and it is to be exchanged for a new one. At the same time, the lifetime of the second cartridge 20 which was previously replaced also expires and is to be replaced with a new one again. Therefore both of the first and the second cartridges 10 and 20, which constitute the developing cartridge, are taken out together from the body 1 for replacement. When about 15,000 sheets of copy paper are printed with use of the apparatus of this example, the lifetime of the second cartridge 20 expires again and it is separately exchanged for a new one. At the time when about 20,000 sheets are printed, both of the first and the second cartridges 10 and 20 are replaced with new ones together again. When about 25,000 sheets are printed, only the second cartridge 20 is replaced with a new one. When the number of the sheets printed with use of the apparatus of this example reaches about 30,000, the lifetime of the photosensitive cartridge 9 expires as listed above, and accordingly it is replaced with a new one. At the same time, the first and the second cartridges 10 and 20 are also replaced with new ones together. In this way, at the time when about 30,000 sheets are printed, all the cartridges are replaced with new ones.

As described above, in the apparatus for the formation of images of the invention, the second cartridge can be separated from the first cartridge so that only the second cartridge can be replaced with a new one, with the first cartridge still kept within the body. Thus, the first and the second cartridges can be replaced with new ones in accordance with their lifetime; since the lifetime of the second cartridge is about half as long as that of the first cartridge, the second cartridge is replaced twice while the first cartridge is replaced once. In this way, both cartridges can be fully used until their lifetime expires, resulting in a reduced cost of the maintenance of the whole apparatus. On the other hand, the volume of toner in the toner storage container of the second cartridge need not be doubled so as to have the lifetime equivalent to that of the first cartridge. This keeps the second cartridge small in size, resulting in a miniaturized apparatus for the formation of images.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An apparatus for the formation of images comprising two process-cartridges, one of which is a photosensitive cartridge including a photosensitive drum, a charger, a cleaning device, and the like, and the other of which is a developing cartridge including a developing device, a toner storage container, and a used toner collecting container, said developing cartridge being separated into a first cartridge including said developing device alone and a second cartridge including said toner storage container and said used toner collecting container; wherein the lifetime of said photosensitive cartridge is approximately a first integer times as long as that of said first cartridge, and the lifetime of said first cartridge is approximately a second integer times as long as that of said second cartridge, where each of said first and second integers is greater than one.

2. An apparatus according to claim 1, wherein used toner which is collected by means of said cleaning device of said photosensitive cartridge is transported into said used toner collecting container of said developing cartridge.

* * * * *